US007954417B2

(12) United States Patent
Nedele

(10) Patent No.: US 7,954,417 B2
(45) Date of Patent: Jun. 7, 2011

(54) CERAMIC ARMORING AND METHOD FOR THE PRODUCTION OF CERAMIC ARMORING

(75) Inventor: Martin Nedele, Reutlingen (DE)

(73) Assignee: Deutsches Zentrum fuer Luft- und Raumfahrt e.V., Cologne (DE)

( * ) Notice: Subject to any disclaimer, the term of this patent is extended or adjusted under 35 U.S.C. 154(b) by 155 days.

(21) Appl. No.: 12/411,072

(22) Filed: Mar. 25, 2009

(65) Prior Publication Data

US 2010/0071536 A1 Mar. 25, 2010

Related U.S. Application Data

(63) Continuation of application No. PCT/EP2007/059832, filed on Sep. 18, 2007.

(30) Foreign Application Priority Data

Sep. 27, 2006 (DE) ..... 10 2006 047 110

(51) Int. Cl.
*F41H 5/04* (2006.01)

(52) U.S. Cl. ..... 89/36.02; 89/906

(58) Field of Classification Search ..... 89/36.02, 89/906, 917, 903, 904
See application file for complete search history.

(56) References Cited

U.S. PATENT DOCUMENTS

| | | | | |
|---|---|---|---|---|
| 3,616,115 | A | 10/1971 | Klimmek | |
| 4,307,140 | A | 12/1981 | Davis | |
| 6,537,654 | B1 | 3/2003 | Gruber et al. | |
| 6,792,843 | B2 | 9/2004 | Mohr et al. | |
| 7,077,306 | B2 * | 7/2006 | Palicka et al. | 89/36.02 |
| 7,479,249 | B2 | 1/2009 | Gahr et al. | |
| 7,681,485 | B2 * | 3/2010 | Neal | 89/36.02 |
| 2005/0217471 | A1 | 10/2005 | Benitsch | |
| 2006/0137517 | A1 * | 6/2006 | Palicka et al. | 89/36.02 |
| 2007/0125223 | A1 | 6/2007 | Heidenreich et al. | |

FOREIGN PATENT DOCUMENTS

| | | | |
|---|---|---|---|
| DE | 2931110 | | 2/1981 |
| DE | 3134341 | A1 | 5/1982 |
| DE | 3942955 | A1 | 7/1991 |
| DE | 4344711 | A1 | 7/1995 |
| DE | 19629310 | A1 | 1/1998 |
| DE | 29813622 | U1 | 4/1999 |
| DE | 19947731 | A1 | 4/2001 |
| DE | 19953259 | A1 | 5/2001 |
| DE | 69707560 | T2 | 6/2002 |
| DE | 29824890 | U1 | 5/2003 |
| DE | 10329822 | A1 | 1/2005 |
| EP | 0810415 | A2 | 12/1997 |
| EP | 1284856 | B1 | 11/2001 |
| EP | 1536199 | A1 | 6/2005 |
| FR | 1396320 | | 12/1965 |
| GB | 2219379 | A | 12/1989 |
| GB | 2336807 | A | 4/1998 |
| GB | 2364956 | A | 2/2002 |
| GB | 2377006 | A | 12/2002 |
| WO | WO-2005/114089 | A1 | 12/2005 |

* cited by examiner

*Primary Examiner* — Michael Carone
*Assistant Examiner* — Jonathan C Weber
(74) *Attorney, Agent, or Firm* — Muncy, Geissler, Olds & Lowe, PLLC

(57) ABSTRACT

A ceramic armoring is provided, comprising a first ceramic layer which has a plurality of segments that are functionally separated by crack stoppers, wherein the crack stoppers serve to prevent cracks propagating from one segment to another segment, at least one second ceramic layer which has a plurality of segments that are functionally separated by crack stoppers, and at least one bonding layer by means of which the first ceramic layer and the second ceramic layer are joined together, wherein the segments of the first ceramic layer are offset with respect to the segments of the second ceramic layer.

41 Claims, 4 Drawing Sheets

CERAMIC ARMORING AND METHOD FOR THE PRODUCTION OF CERAMIC ARMORING

This application is a continuation of international application number PCT/EP2007/059832 filed on Sep. 18, 2007.

The present disclosure relates to the subject matter disclosed in international application number PCT/EP2007/059832 of Sep. 18, 2007 and German application number 10 2006 047 110.5 of Sep. 27, 2006, which are incorporated herein by reference in their entirety and for all purposes.

BACKGROUND OF THE INVENTION

The invention relates to ceramic armoring comprising a first ceramic layer having a plurality of segments which are functionally separated by crack stoppers, wherein the crack stoppers serve to prevent the propagation of cracks from one segment to another segment, at least one second ceramic layer having a plurality of segments which are functionally separated by crack stoppers, and at least one bonding layer by means of which the first ceramic layer and the second ceramic layer are joined together.

Furthermore, the invention relates to a method for the production of ceramic armoring.

Ceramic armor plate that is formed in one piece and comprises a plurality of joined segments which are functionally separated by crack stoppers, wherein the crack stoppers serve to prevent cracks propagating from one segment to a neighboring segment is known from WO 2005/114089 A1.

A composite sandwich material which comprises laminate layers of ceramic material having a thickness of between 0.5 mm and 3.0 mm is known from GB 2 336 807 A. A bonding material is arranged between the ceramic layers. The ceramic layers serve as ballistic protection barriers against projectiles.

A flexible penetration-resistant protective sheet of material comprising several superimposed layers made of a woven fabric and/or a knitted fabric consisting of high strength fibers, particularly, aramid fibers is known from DE 29 31 110 A1. The adjacent layers are fastened together over the extent of the surface thereof.

Protective armoring and in particular ballistic light weight protective armoring is known from DE 298 24 890 U1, this armoring comprising at least one molded body made of a projectile-resistant material and a backing structure for holding the molded body together and producing a planar formation. The molded body consists of a woven fabric, a knitted fabric or knitwear or a similar fibrous material made of carbon which is converted into carbon-fiber-reinforced silicon carbide due to the infiltration of silicon in the course of a siliconization process.

An armored composite material is known from EP 1 284 856 B1, this comprising a front layer which faces the threatened side and is arranged on a first support layer and consists of a plurality of snugly-fitting, mutually adjoining front layer segments. Furthermore, there is provided a rear layer remote from the threatened side and also a supporting layer which is arranged between the front layer and the rear layer and consists of a plurality of supporting layer segments, wherein a surface of the supporting layer segments is parallel to the front layer and is of the same size as or smaller than the surface of the front layer segments parallel to the front layer and wherein the supporting layer segments are arranged below the front layer segments in such a manner that the bordering edges thereof are aligned one above the other.

SUMMARY OF THE INVENTION

In accordance with the present invention, a ceramic armoring is provided having enhanced resistance to damage.

In accordance with an embodiment of the invention, segments of the first ceramic layer are offset with respect to the segments of the second ceramic layer.

Such, defined containment of surface damage or volume damage is obtained. The region of damage is thereby limited. Furthermore, there is a resulting improvement in its ability to withstand multi-hits.

The region of a ceramic layer subject to damage is greatest in the case where an object hits a crossing point since several segments can then be damaged. By virtue of the solution in accordance with the invention wherein the segments in neighboring ceramic layers are offset with respect to each other, the "depth of damage" is reduced. If an object hits a crossing point in the second ceramic layer, there is then a segment of the first ceramic layer located underneath the crossing point.

Ceramic fragments can be prevented from being chipped off or such a chipping action can at least be reduced by means of the bonding layer between the first ceramic layer and the second ceramic layer.

In the case of the ceramic armoring in accordance with the invention, propagation of the damage can also be reduced by appropriate selection of the thickness of the ceramic layers. There are no fundamental restrictions in regard to the thickness. The ceramic layers can be manufactured e.g. with integrated crack stoppers in a simple manner.

Due to the solution in accordance with the invention, it is also possible to functionally optimize the individual ceramic layers in order to minimize the volume damage in dependence on the field of application. For example, provision may be made for the segments of different ceramic layers to have differing lateral dimensions. It is also possible for the different ceramic layers to be of different thicknesses. The dimensions of a segment are, for example, adapted to the size of objects the impact of which is to be feared. For example, provision is made for a more outwardly located ceramic layer to have segments of smaller lateral dimensions than a more inwardly located ceramic layer. The more outwardly located ceramic layer serves to give protection in regard to smaller projectiles whilst the more inwardly located ceramic layer serves to protect against larger projectiles. The result deriving from the mutual off-set of the segments is that the protective effect of the ceramic layer that serves for protecting against large projectiles is not substantially restricted by the impact of a smaller projectile on a more outwardly located ceramic layer.

Provision may be made for there to be a plurality of (even more than two) ceramic layers which are appropriately matched in terms of the thickness thereof and the lateral dimensions of their segments such as to obtain an optimal protective effect in regard to the impact of objects thereon.

It is expedient if the segments of the first ceramic layer and the segments of the second ceramic layer are offset in at least one transverse direction relative to a direction in which the first ceramic layer and the second ceramic layer succeed one another. The volume damage can thus be kept low in the event of the impact of an object.

For the same reason, it is expedient if the crack stoppers in the first ceramic layer and the crack stoppers in the second ceramic layer are offset in at least one transverse direction relative to a direction in which the first ceramic layer and the second ceramic layer succeed one another. This thus prevents an object from hitting crossing points in both an outer ceramic layer and in the underlying ceramic layer.

It is especially advantageous if all the crack stoppers in the first ceramic layer and all the crack stoppers in the second ceramic layer are offset with respect to each other. The surface damage or the volume damage can thus be contained in a defined manner and thereby kept low.

For the same reason, it is expedient if the crack stoppers in the first ceramic layer are arranged such as to be non-aligned with the crack stoppers in the second ceramic layer.

The first ceramic layer and the second ceramic layer are located one on top of the other. In particular, they succeed one another in the thickness direction of the first ceramic layer or the second ceramic layer.

It is especially advantageous, if the first ceramic layer and the second ceramic layer are joined together in laminar manner by the at least one bonding layer. In particular, there is full surface contact between the at least one bonding layer and the first ceramic layer and the second ceramic layer. In consequence, ceramic fragments can be prevented from being chipped off after an impact in an effective manner.

It is expedient, if the at least one bonding layer is an adhesive layer. Such a bonding layer can be produced in a simple manner. The adhesive material employed may, for example, be a hot-melt adhesive such as PVB (polyvinyl butyral).

It is expedient, if the at least one bonding layer is joined adhesively to the first ceramic layer. Ceramic fragments can thus be prevented from being chipped off in an effective manner. In particular, provision is made for a laminar-type bond wherein there is preferably full surface contact between the bonding layer and the first ceramic layer.

For the same reason, it is expedient if the at least one bonding layer is joined adhesively to the second ceramic layer.

Expediently, the at least one bonding layer is a layer of synthetic material. It is advantageous thereby, if the latter exhibits a certain degree of elasticity in order to be able to effectively prevent ceramic fragments from being chipped off.

Expediently, the at least one bonding layer is of lesser thickness than either the first ceramic layer or the second ceramic layer. The thickness of the ceramic armoring is thus effectively determined by the ceramic layers.

In particular, the thickness of the first ceramic layer and/or the second ceramic layer is at least 5 mm. The first ceramic layer and/or the second ceramic layer can thus be manufactured with a large surface area using one or more ceramic plates in a simple manner. According to a rule of thumb that is valid for monolithic ceramic plates, presently known manufacturing techniques for ceramic plates permit of width and longitudinal dimensions which are such that they are not greater than approximately 30-times the thickness.

In particular, it is possible for the thickness of the first ceramic layer and/or the second ceramic layer to be greater than or equal to 8 mm or, in dependence on the application, to be greater than or equal to 15 mm. The first ceramic layer and/or the second ceramic layer can thus be manufactured with a large surface area using one or more ceramic plates in a simple manner (in dependence on the surface area that is to be covered by the ceramic armoring).

Expediently, the crack stoppers are arranged along a line or form a line. The line can be straight or curved or it could also be discontinuous. The respective ceramic layer can thereby be divided up into segments, wherein the segments are functionally separated by crack stoppers.

It is especially advantageous, if the crossing points of the crack stopper lines in one ceramic layer when projected onto the other ceramic layer lie within a segment of the other ceramic layer. This thus prevents an object hitting a crossing point of one ceramic layer from also hitting a crossing point of the other ceramic layer. In consequence, the surface damage or the volume damage can be contained in a defined manner.

It is in principle possible here for the crack stoppers to reach right up to a crossing point of the crack stopper lines. Defined containment of the surface damage can thereby be achieved. It is in principle also possible thereby for the crack stoppers not to reach as far as a crossing point.

It is especially advantageous, if provision is made for at least one outer covering layer. If a projectile has hit the ceramic armoring, then ceramic debris ensues. A chipping off process is prevented by the at least one bonding layer. The ceramic debris is held "in position" in the corresponding ceramic layer with the aid of the at least one covering layer. Should it be hit by a further object, the kinetic energy of the object can be reduced by means of this ceramic debris that is being held in position so as to thereby keep down the damage which is caused by this object.

In particular, the at least one covering layer covers crack stoppers. This thereby results in debris being held on the ceramic armoring in an effective manner.

For example, the at least one covering layer is formed by an (adherent) foil in order to enable the debris to be effectively held in position on the corresponding ceramic layer.

For example, the at least one covering layer is stuck on. In particular, the adhesion is of a laminar nature resulting in substantially complete contact between the covering layer and the outer ceramic layer.

It is especially advantageous, if the crack stoppers are integrated into the first ceramic layer and/or the second ceramic layer. The ceramic layers can thus be manufactured with integrated crack stoppers in a simple manner. The crack stoppers are, for example, produced by mechanically working a carbon-containing preform in its green state or after pyrolysis.

In particular, the crack stoppers are produced during the manufacturing stage for the first ceramic layer and/or the second ceramic layer. Consequently, the crack stoppers do not have to be produced subsequently by mechanically working a—hard and brittle—ceramic material for example.

In one simple embodiment, the crack stoppers are formed by recesses and/or from recesses. Such recesses can be produced in a simple manner by working down from the surface. Corresponding crack stoppers are described in WO 2005/114089 A1 to which reference is expressly made.

The recesses may pass right through or not fully through the first ceramic layer and/or the second ceramic layer in the thickness direction thereof. It is thus in principle possible for the individual segments to be not only functionally separated by the crack stoppers, but also to be geometrically separated thereby, i.e. for the individual segments to be individual components. Provision could also be made for the individual segments to be coherent and formed in one piece in a ceramic plate for example. A corresponding ceramic layer can be produced in a simple and economical manner since individual ceramic tiles do not have to be jointed into one another, but a large surface area is coverable with minimal manufacturing expenditure.

In one embodiment, the first ceramic layer and/or the second ceramic layer are formed by one or more one-piece ceramic plates. As to whether one or more ceramic plates are to be used is dependent on the size of the surface area that is to be protected by the ceramic armoring. For production purposes, it is advantageous if the number of ceramic plates is minimized. In particular, a ceramic plate comprises a plurality of segments that are joined together.

It is particularly expedient if the neighboring segments are connected to the at least one ceramic plate in one-piece manner. In consequence, the corresponding ceramic layer can be manufactured in a simple and economical manner. It is also possible in a simple manner for example, to manufacture curved ceramic layers which cover a large surface area whereby the ceramic layers can also be of greater thickness (in particular, more than 5 mm).

Provision may, for example, be made for the length and breadth of the at least one ceramic plate to be at least 150 mm and preferably at least 800 mm. Consequently, a large surface area requiring armoring can be covered with minimal manufacturing expenditure.

Expediently, the spacing between crack stoppers lies in a range of between 5 mm and 100 mm. Consequently, defined containment of the surface damage together with minimization thereof can be achieved with minimal manufacturing expenditure. In turn thereby, volume damage can be contained in defined manner. The spacing (which defines the size of the segments) is adapted to the particular field of application. For example, it is advantageous for the segments to be made larger if the impact of large projectiles is to be feared, as compared with segments if the impact of smaller projectiles is to be feared.

The ceramic material of the first ceramic layer and/or the second ceramic layer is an oxidic material or a non-oxidic material.

In particular, the ceramic material is a carbide ceramic material such as silicon carbide for example.

It can be expedient depending upon the field of application, for the first ceramic layer and/or the second ceramic layer to be made of a monolithic ceramic material or of a fiber-reinforced ceramic material. The fiber reinforcement can be effected by means of short fibers, long fibers or endless-loop fibers. The fiber reinforcement could also result from the use of a cellulose-containing starting material. In certain circumstances, fiber-reinforced ceramic plates can be manufactured with larger lateral dimensions than a monolithic ceramic plate of the same thickness.

It is expedient if the segments of different ceramic layers have differing dimensions. Thereby, the dimensions can be different in a lateral direction and/or the thickness dimensions may be different. Precise adaptation to a special application can thereby be achieved. For example, one or more ceramic layers may be provided, these being formed in such a manner that they exhibit a special armoring effect with respect to larger projectiles. This is attainable in that the segment size and possibly also the segment thickness of the segments in such a ceramic layer are adapted to the projectiles that are to be expected; in the case of larger projectiles, the dimensions of the segments should usually be selected to be greater than those for smaller projectiles.

It is particularly expedient if the segments of a more outwardly located ceramic layer have smaller dimensions than the segments of a more inwardly located ceramic layer. The outer ceramic layer can, for example, serve as a fragmentation protector and in particular as a protective layer in the face of smaller projectiles. Due to the offset of the segments relative to each other, substantial damage to a more inwardly located ceramic layer caused by striking projectiles can be prevented to a large extent (the more inwardly located ceramic layer serving to protect against larger projectiles in particular).

Furthermore, in accordance with the present invention, a method for the production of ceramic armoring is provided which can be carried out in a simple manner and with the aid of which one can obtain ceramic armoring having effective damage tolerance.

In accordance with an embodiment of the invention, a first ceramic layer incorporating crack stoppers and a second ceramic layer incorporating crack stoppers are produced, and the first ceramic layer is adhered to the second ceramic layer by a bonding layer in such a manner that the crack stoppers of the first ceramic layer and the crack stoppers of the second ceramic layer are offset in at least one transverse direction relative to a direction in which the first ceramic layer and the second ceramic layer succeed one another.

Due to the method in accordance with the invention, ceramic armoring exhibiting improved multi-hit capabilities with defined containment of surface damage or volume damage can be manufactured in a simple and economical manner.

Further advantages of the method in accordance with the invention have already been mentioned in connection with the ceramic armoring in accordance with the invention.

Further advantageous embodiments have likewise already been mentioned in connection with the ceramic armoring in accordance with the invention.

In particular, the first ceramic layer and/or the second ceramic layer is produced by means of at least one one-piece ceramic plate. In turn, the one-piece ceramic plate comprises a plurality of segments which, in particular, cohere in one piece manner. A large surface area can thus be covered in a simple manner. Furthermore, curved ceramic layers can also be manufactured in a simple manner.

In particular, crack stoppers are produced in one or more preforms for the first ceramic layer and/or the second ceramic layer before the ceramizing process. For example, crack stoppers are produced in a green body before pyrolysis and/or are produced in a carbon preform after the pyrolysis of the green body. Such crack stoppers can be produced in a simple manner by a mechanical treatment, for example, by milling slots or recesses.

It is expedient if the crack stoppers are produced in the form of recesses and/or cracks in a carbon-containing preform. Such crack stoppers can be realized with relatively little expenditure.

It is expedient if a foil is arranged on the outer ceramic layer. Debris can be held on the corresponding ceramic layer by this foil in order to improve the multi-hit capability.

The following description of preferred embodiments taken in conjunction with the drawing serves for a more detailed explanation of the invention. Therein:

DETAILED DESCRIPTION OF THE INVENTION

Figure 1:
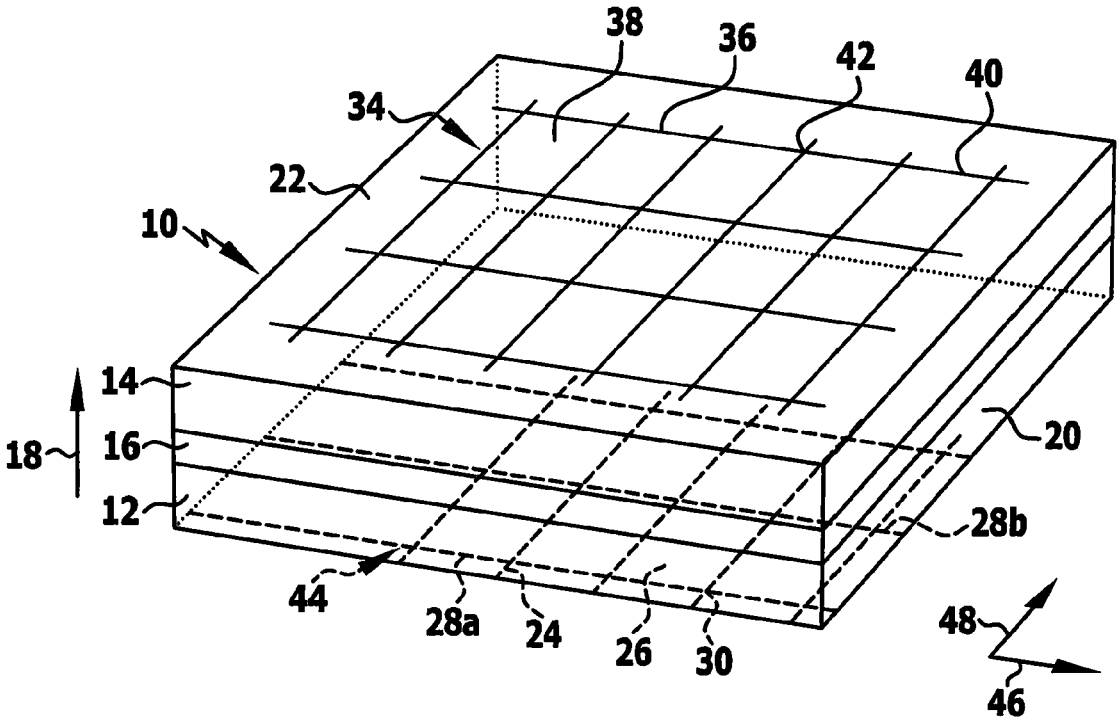
FIG. 1 shows a schematic (partial) illustration of an exemplary embodiment of the ceramic armoring in accordance with the invention.
Figure 2:
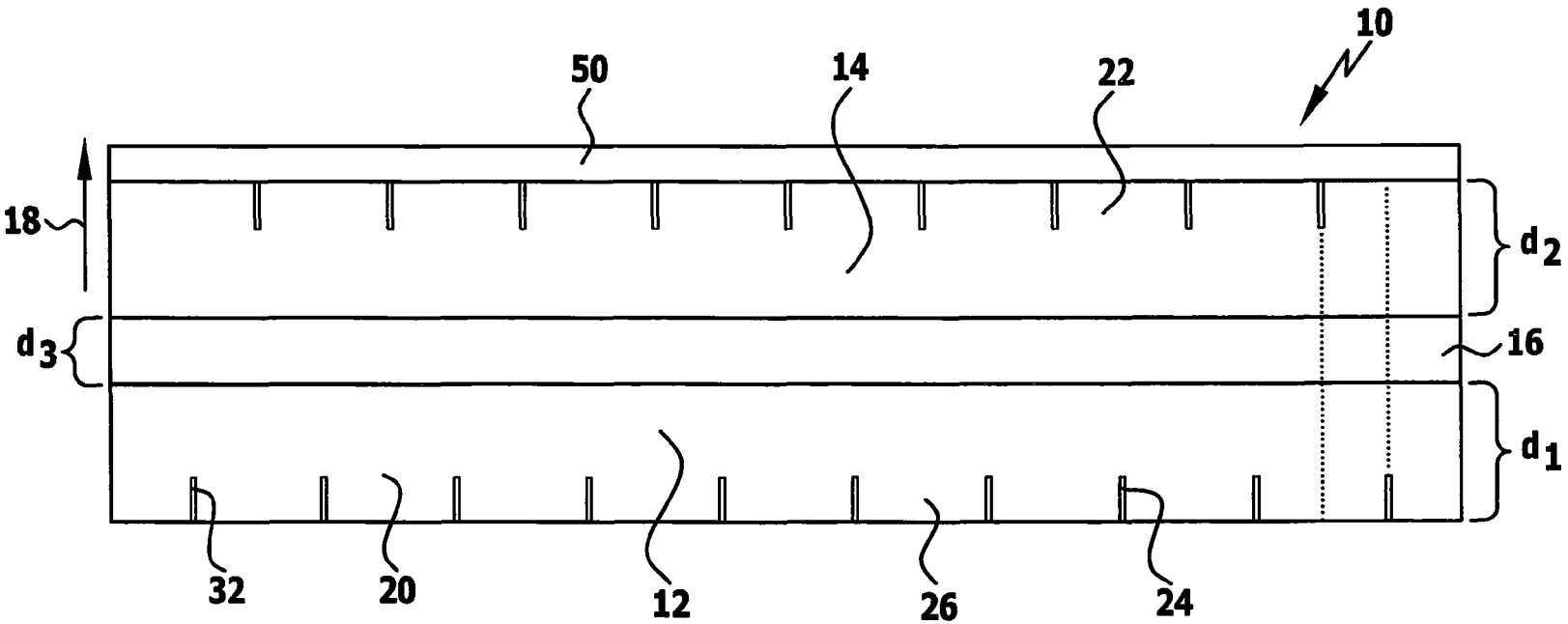
FIG. 2 a sectional view of the ceramic armoring in accordance with FIG. 1.
Figure 3:
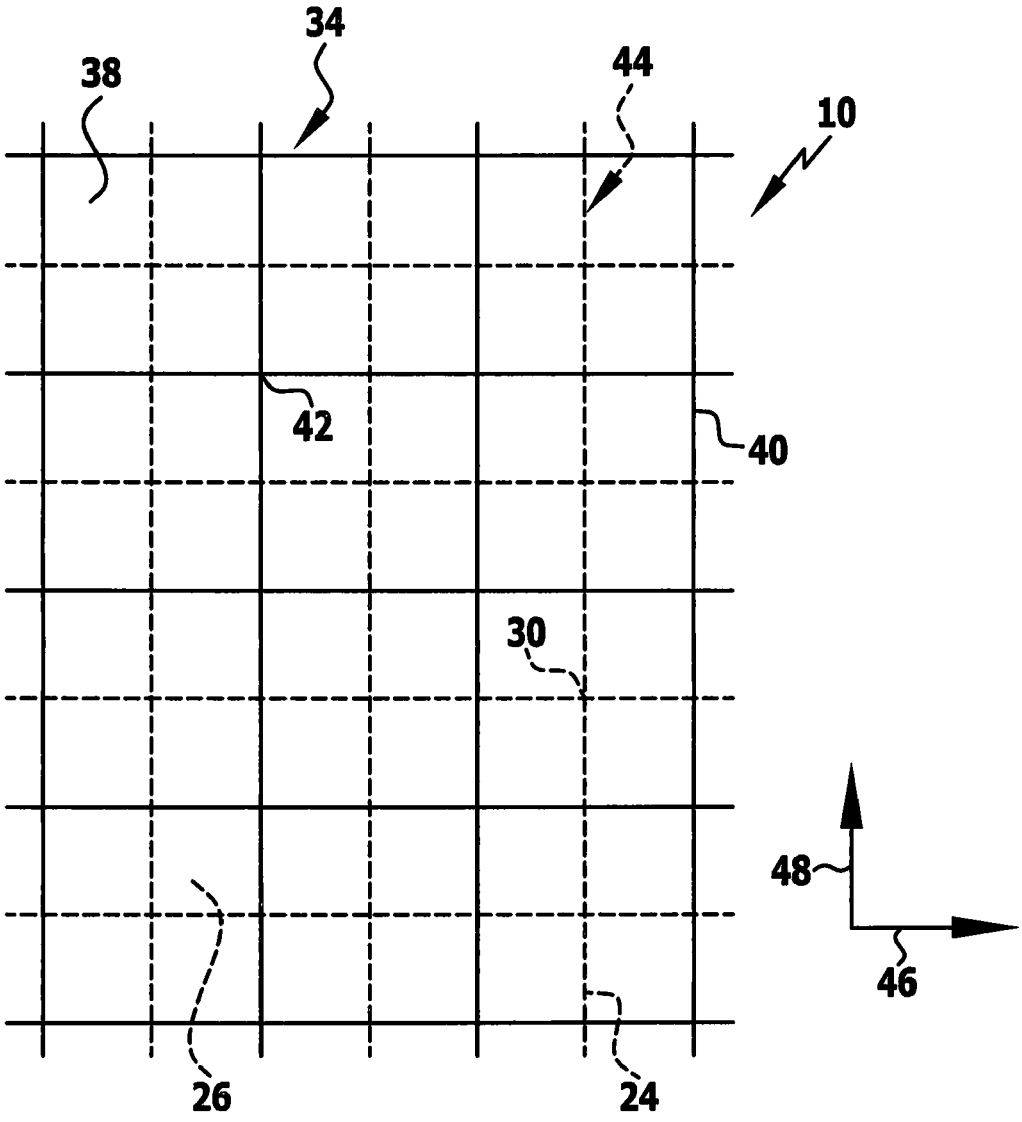
FIG. 3 a plan view of the ceramic armoring in accordance with FIG. 1.
Figure 4:
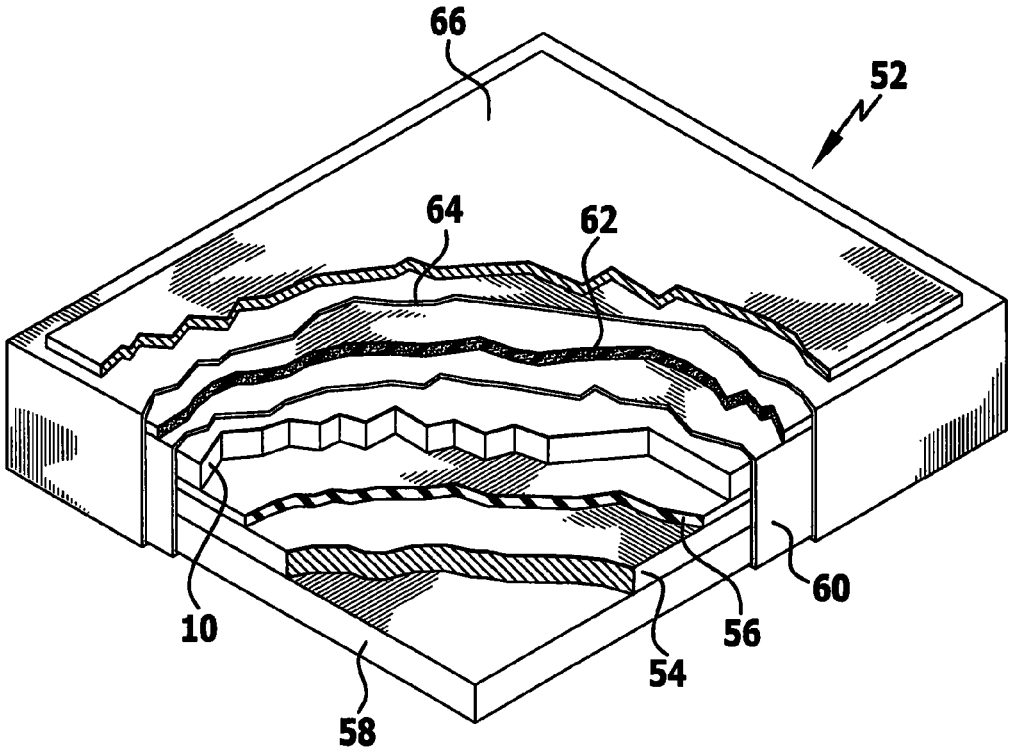
FIG. 4 a perspective partial sectional view of an exemplary embodiment of an armoring system.

An exemplary embodiment of armoring in accordance with the invention, which is shown in FIGS. 1 to 3 and referenced by 10 therein, comprises a first ceramic layer 12 and a second ceramic layer 14. The first ceramic layer 12 and the second ceramic layer 14 are joined together adhesively by a bonding layer 16. The bonding layer 16 is an adhesive layer, wherein the first ceramic layer 12 is adhesively joined to the bonding layer 16 and the second ceramic layer 14 is adhesively joined to the bonding layer 16.

The bonding layer 16 is made of a synthetic material. The material has a certain degree of elasticity. In particular, the first ceramic layer 12 and the second ceramic layer 14 are laminar and in particular, they are joined to the bonding layer 16 over substantially the entirety of their respective surfaces.

A possible material for the bonding layer 16 is a hot-melt adhesive material such as PVB (polyvinyl butyral).

The first ceramic layer 12 and the second ceramic layer 14 succeed one another in a direction 18. This direction 18 is also the thickness direction of the first ceramic layer 12 and the second ceramic layer 14. The first ceramic layer has a thickness $d_1$ and the second ceramic layer has a thickness $d_2$. The bonding layer 16 has a thickness $d_3$.

The thicknesses $d_1$, $d_2$, $d_3$ may be uniform over the respective surface areas or they may also vary.

The first ceramic layer 12 and the second ceramic layer 14 can be formed with parallel spaced flat surfaces or else with parallel spaced curved surfaces. It is also possible for the first ceramic layer 12 and/or the second ceramic layer 14 to comprise spaced surfaces which are not parallel to each other.

The thickness $d_3$ of the bonding layer 16 is smaller and in particular considerably smaller than the respective thicknesses $d_1$ of the first ceramic layer 12 and $d_2$ of the second ceramic layer 14.

Preferably, the thicknesses $d_1$ and $d_2$ are equal to or greater than 5 mm and in particular, greater than 10 mm. Provision can also made for the thicknesses $d_1$ and/or $d_2$ to be equal to or greater than 30 mm.

There is an existing rule of thumb for the fabrication of monolithic ceramics using known manufacturing techniques in accord with which a ceramic element is producible if the width and length thereof are not greater than approximately 30 times the thickness of the ceramic element. Thus, the greater the selected thicknesses $d_1$ of the first ceramic layer 12 and $d_2$ of the second ceramic layer 14, the greater the attainable length and width dimensions of the ceramic elements by means of which the first ceramic layer 12 and the second ceramic layer 14 are produced.

The ceramic elements by means of which the first ceramic layer 12 and the second ceramic layer 14 are produced are, in particular, ceramic plates. The first ceramic layer 12 can be formed by one or more ceramic plates 20. The second ceramic layer 14 can likewise be formed by one or more ceramic plates 22. Hereby and depending upon the field of application, the ceramic plates 20, 22 can be flat or have curved surfaces.

The first ceramic layer 12 is provided with crack stoppers 24. The crack stoppers sub-divide the first ceramic layer 12 into segments 26, whereby adjacent segments 26 are functionally separated by crack stoppers 24. The crack stoppers serve to prevent the propagation of cracks from one segment 26 to an adjacent segment 26. The crack stoppers 24 represent a kind of predetermined breaking point. If a certain segment 26 is hit and destroyed by an object, then the crack stoppers 24 prevent the neighboring segments from likewise being destroyed.

The crack stoppers 24 lie on crack stopper lines 28*a*, 28*b* or form such crack stopper lines. The crack stopper lines 28*a*, 28*b* cross each other at crossing points 30. It is possible thereby, for the crack stoppers 24 to run right up to the crossing points 30 or for them to be spaced from such crossing points 30.

There are various ways in which crack stoppers can be formed. Possible ways of forming the crack stopper are described in WO 2005/114089 A1. Reference is expressly made to this specification.

For example, the crack stoppers are formed by fissures or by means of flaws.

In particular, provision is made for the crack stoppers 24 to be formed by recesses 32. These recesses 32 are preferably integrated into the respective ceramic plates 20. They may pass completely through the plate in the thickness direction 18 or they may not pass completely through. Advantageously the ceramic plates 20, 22 which comprise a plurality of segments 26 are formed in one piece, i.e. adjacent segments 26 of a ceramic plate 20, 22 cohere in one-piece manner.

For example, the recesses are produced in the thickness direction 18 of the respective ceramic plate 20, 22. The recesses may run at an angle of at least approximately 0° but they could also run at an angle of between 15° and 45° relative to the direction 18. For example, the crack stoppers 24 are formed by grooves and/or from grooves or by perforations and/or from slots.

In one exemplary embodiment, the depth of the grooves or slots lies in a range of between 0.05 and 0.9 of the thickness $d_1$ of the first ceramic layer 12 in the direction 18.

A typical spacing between crack stoppers 24 lies in a range of between 5 mm and 100 mm. This range of spacings of between 5 mm and 100 mm then also defines a typical size (length and breadth) for the segments 26.

It is expedient if the recesses 32 are integrated into the ceramic plate 20 and in particular, if they are formed in the solid material of the ceramic plate 20. Such crack stoppers 24 can be produced during the manufacturing phase of the ceramic plate 20. This is described in WO 2005/114089 A1.

The material of the first ceramic layer 12 can be an oxidic ceramic material or a non-oxidic ceramic material. For example, the material of the first ceramic layer 12 is a carbide-ceramic material such as SiC. The crack stoppers 24 are introduced into a carbon-containing perform, and in particular, before the ceramizing process. It is possible thereby for them to be introduced into a carbon body after pyrolysis and/or for them to be introduced into a carbon-containing preform that is still awaiting pyrolysis. It is also possible thereby, for the carbon-containing body to be manufactured by means of a biomorphous material which, in particular, contains cellulose.

The second ceramic layer 14 is in principle formed in the same manner as the first ceramic layer 12. The second ceramic layer 14 likewise comprises a crack stopper system 34 by means of which segments 38 that are functionally separated by crack stoppers 36 are formed. The crack stopper system 34 of the second ceramic layer 14 likewise comprises crack stopper lines 40 (these do not necessarily have to be straight) which intersect at crossing points 42.

The crack stopper system 34 in the second ceramic layer 14 is offset with respect to a crack stopper system 44 in the first ceramic layer 12. This means that the crack stoppers 36 of the second ceramic layer 14 are mutually offset with respect to the crack stoppers 24 of the first ceramic layer 12 in a first transverse direction 46 and/or in a second transverse direction 48. The first transverse direction 46 is perpendicular to the second transverse direction 48. In their turn, both the first transverse direction 46 and the second transverse direction 48 are perpendicular to the direction 18. The first transverse direction 46 and the second transverse direction 48 are the directions in which the surfaces of the first ceramic layer 12 and the second ceramic layer 14 extend.

Due to the offset of the crack stopper system 44 with respect to the crack stopper system 34, the segments 38 of the second ceramic layer 14 are also offset with respect to the segments 26 of the first ceramic layer 12.

The projections of the crossing points 42 of the crack stopper lines 40 of the crack stopper system 34 in the second ceramic layer 14 onto the first ceramic layer 12 lie within segments 26 of the first ceramic layer 12. In a corresponding manner, the projections (in the direction 18) of the crossing points 30 of the first ceramic layer 12 onto the second ceramic layer 14 lie within segments 38 of the second ceramic layer 14.

The crack stoppers 36 of the second ceramic layer 14 are aligned with reference to the direction 18 such as to be mutually out-of-alignment.

Hereby, the geometrical arrangement of the segments 26 and 38 can be cubical. However, other arrangements are possible in dependence on the field of use.

It is also possible to have a further ceramic layer (a third ceramic layer) joined adhesively to the second ceramic layer 14 by a corresponding bonding layer (not shown in the drawing). This third ceramic layer likewise comprises a crack stopper system which is then offset with respect to the crack stopper system 34 of the second ceramic layer 14. Yet further corresponding ceramic layers could then be provided.

The ceramic armoring 10 has a layered structure in which the first ceramic layer 12 and at least one further ceramic layer namely, the second ceramic layer 14 succeed one another, wherein the bonding layer 16 interconnects the first ceramic layer 12 and the second ceramic layer 14.

Provision may additionally be made for a covering layer 50 which sits on the outer ceramic layer. In the indicated exemplary embodiment according to FIGS. 1 to 3, the outer ceramic layer is the second ceramic layer 14. The covering layer 50 is, in particular, formed from a foil material which is stuck onto the second ceramic layer 14. The covering layer 50 is preferably made continuous and, for example, covers the crack stopper system 34. The covering layer 50 serves to hold the fragments, which occur when an object hits the ceramic armoring 10, on the ceramic armoring 10. Preferably, the covering layer 50 exhibits a certain degree of elasticity.

The ceramic armoring 10 can form an armored system or be part of an armored system.

For example, the ceramic armoring 10 can be integrated into an armoring system such as is schematically shown in the Figure where it bears the general reference 52. Such an armoring system is described in DE 697 07 560 T2 (EP 0 810 415 B1). Reference is expressly made to this document.

In the armoring system 52, the ceramic armoring 10 is arranged on a structure carrier layer 54 (a backing). The structure carrier layer 54 can be made of aluminium for example, or of composite materials such as carbon-kevlar.

The ceramic armoring 10 is, for example, joined to the structure carrier layer 54 by means of an adhesive layer 56.

Provision may also be made for a fragmentation layer 58 upon which the structure carrier layer 54 is arranged. The fragmentation layer 58 serves to minimize shattering of the structure carrier layer 54.

The ceramic armoring 10 can be covered over by several protective layers 60, 62, 64. The armoring system 52 is bounded upwardly by a steel plate 66. In regard to the structure thereof, reference is made to EP 0 810 415 B1. The same structure as that described there can be used, but instead of a plurality of tiles, the ceramic armoring in accordance with the invention 10 is employed.

The ceramic armoring 10 is manufactured as follows:

One or more ceramic plates 20, 22 are produced in order to form the first ceramic layer 12 and the second ceramic layer 14. The respective crack stopper systems 34 and 44 are formed integrally therein at the same time.

For example, a carbon-containing preform is initially produced for each of the ceramic plates 20, 22. To this end for example, a cellulose-containing material is used and a porous preform is produced. This carbon-containing porous preform is converted by means of a pyrolysis process into an open-pored carbon body. Following pyrolysis but prior to the ceramizing process, the recesses 32 are introduced into the porous preform or into the carbon body. For example, a rectangular grid of recesses 32 is produced.

As was mentioned above, it is also possible for the recesses 32 to be introduced into the carbon-containing body (green body) before pyrolysis. It is easier to mechanically work such a green body. The gap between neighboring segments is made smaller due to the contraction occurring during pyrolysis.

The carbon body is ceramized after the pyrolysis process. This can be effected by means of a carbide-forming infiltration process for example. For example, a silicon carbide ceramic is produced by utilizing a silicon infiltration process.

It is possible thereby for the recesses 32 to be filled with a parting agent such as boron nitride before the ceramizing process.

After producing the ceramic plates 20, 22, the first ceramic layer 12 and the second ceramic layer 14 are formed by adhering the ceramic plates 20, 22 together with the aid of the bonding layer 16. In so doing, the ceramic plates 20, 22 are positioned relative to each other in such a manner that the crack stopper systems are 34, 44 are mutually offset.

Subsequently, the covering layer 50 is arranged on the second ceramic layer 14.

Due to the solution in accordance with the invention, the damage-resistance properties of the ceramic armoring are improved especially in the case of repeated impacts i.e. the multi-hit capabilities of the ceramic armoring 10 are improved. Due to the offset arrangement of the crack stopper systems 34 and 44, the surface damage or the volume damage can be contained in a defined manner.

If an object hits the ceramic armoring 10, then one or more segments 26 are destroyed. Thereby however, the object (the projectile) is also destroyed. Due to the crack stopper system 34 of the second ceramic layer 14, propagation of the destruction to further segments 26 is prevented.

A maximum amount of damage can be caused if an object hits a crossing point 30 of the crack stopper system 34.

Due to the composite structure of the first ceramic layer 12 and the second ceramic layer 14 with offset crossing points, the "depth of damage" is reduced since, in the event of an object striking a crossing point 30 of the second ceramic layer 14, there is no crossing point succeeding the crossing point 30 in the first ceramic layer 12.

In addition, due to the bonding layer 16 which, in particular, is an adhesive layer, the chipping-off of ceramic fragments after the impact of an object can at least be reduced.

It is also possible to manufacture the ceramic layers 12, 14 with greater thicknesses in order to minimize the propagation of depth-damage in this way.

Provision may be made here for the first ceramic layers 12, 14 to be made from a fiber-reinforced preform. Production of a very large surface area is possible, whereby there can be produced preforms (green articles) that may even be multiply curved.

The covering layer 50 likewise serves to hold ceramic fragments on the ceramic armoring. Ceramic debris results from the impact of an object. This ceramic debris can be held on the ceramic armoring 10 and in particular on the corresponding ceramic layer 14 with the aid of the covering layer 50. This thus results in improved multi-hit capabilities since any further impact of an object will not encounter a "blank spot", but rather will hit the debris and thereby lose a corresponding amount of kinetic energy. The effect is comparable with the impact of an object on a sand bag.

The ceramic armoring 10 can be constructed so as to match a particular application. For example, provision may be made for a more deeply located ceramic layer to comprise segments having greater lateral dimensions and/or greater thickness dimensions than a more outwardly located ceramic layer such as the ceramic layer 14. The more inwardly located ceramic layer 12 then serves for example as a protective armored layer in regard to larger projectiles, whilst the more outwardly located ceramic layer serves as a protective armored layer to provide protection from fragmentation damage and in regard to smaller projectiles. Due to the offset of the segments of the first ceramic layer 12 relative to the second ceramic layer 14 and in particular due to the offset arrangement of the crack stoppers 24 and 36, the effect can be achieved that damage to the more outwardly located ceramic layer 14 caused by a smaller projectile for example will not substantially damage the more inwardly located first ceramic layer 12.

The invention claimed is:

1. Ceramic armoring, comprising:

a first ceramic layer which has a plurality of segments that are functionally separated by crack stoppers;

wherein the crack stoppers serve to prevent cracks propagating from one segment to another segment;

at least one second ceramic layer which has a plurality of segments that are functionally separated by crack stoppers; and at least one bonding layer by means of which the first ceramic layer and the second ceramic layer are joined together;

wherein the segments of the first ceramic layer are offset with respect to the segments of the second ceramic layer; and wherein the segments of different ceramic layers have differing dimensions, the segments of a more outwardly located ceramic layer have smaller dimensions than the segments of a more inwardly located ceramic layer.

2. Ceramic armoring according to claim 1, wherein the segments of the first ceramic layer and the segments of the second ceramic layer are offset in at least one transverse direction relative to a direction in which the first ceramic layer and the second ceramic layer succeed one another.

3. Ceramic armoring according to claim 1, wherein crack stoppers in the first ceramic layer and crack stoppers in the second ceramic layer are mutually offset in at least one transverse direction relative to a direction in which the first ceramic layer and the second ceramic layer succeed one another.

4. Ceramic armoring according to claim 3, wherein all the crack stoppers in the first ceramic layer and all the crack stoppers in the second ceramic layer are offset with respect to each other.

5. Ceramic armoring according to claim 1, wherein the crack stoppers in the first ceramic layer are arranged such as to be non-aligned with the crack stoppers in the second ceramic layer.

6. Ceramic armoring according to claim 1, wherein the first ceramic layer and the second ceramic layer are located one above the other.

7. Ceramic armoring according to claim 1, wherein the first ceramic layer and the second ceramic layer are joined together in laminar manner by the at least one bonding layer.

8. Ceramic armoring according to claim 1, wherein the at least one bonding layer is an adhesive layer.

9. Ceramic armoring according to claim 1, wherein the at least one bonding layer is joined adhesively to the first ceramic layer.

10. Ceramic armoring according to claim 1, wherein the at least one bonding layer is joined adhesively to the second ceramic layer.

11. Ceramic armoring according to claim 1, wherein the at least one bonding layer is a layer of synthetic material.

12. Ceramic armoring according to claim 1, wherein the at least one bonding layer is of lesser thickness than each of the first ceramic layer and the second ceramic layer.

13. Ceramic armoring according to claim 1, wherein the thickness of the first ceramic layer and the second ceramic layer is at least 5 mm.

14. Ceramic armoring according to claim 1, wherein the thickness of the first ceramic layer and the second ceramic layer is at least 8 mm.

15. Ceramic armoring according to claim 1, wherein the thickness of the first ceramic layer and the second ceramic layer is at least 15 mm.

16. Ceramic armoring according to claim 1, wherein crack stoppers are arranged along a line or form lines.

17. Ceramic armoring according to claim 16, wherein crossing points of the crack stopper lines in one ceramic layer projected onto the other ceramic layer lie within a segment of the other ceramic layer.

18. Ceramic armoring according to claim 16, wherein crack stoppers extend up to a crossing point of the crack stopper lines.

19. Ceramic armoring according to claim 1, wherein at least one outer covering layer is provided.

20. Ceramic armoring according to claim 19, wherein the covering layer covers crack stoppers.

21. Ceramic armoring according to claim 19, wherein the at least one covering layer is formed by a foil.

22. Ceramic armoring according to claim 19, wherein the at least one covering layer is stuck on.

23. Ceramic armoring according to claim 1, wherein the crack stoppers are integrated into the first ceramic layer and the second ceramic layer.

24. Ceramic armoring according to claim 23, wherein the crack stoppers are produced during manufacture of the first ceramic layer and the second ceramic layer.

25. Ceramic armoring according to claim 1, wherein crack stoppers are formed by recesses and from recesses.

26. Ceramic armoring according to claim 25, wherein the recesses pass through or do not pass fully through the first ceramic layer and the second ceramic layer in a thickness direction.

27. Ceramic armoring according to claim 1, wherein crack stoppers are formed by groves and slots and perforations.

28. Ceramic armoring according to claim 1, wherein the first ceramic layer and the second ceramic layer are formed by one or more one-piece ceramic plates.

29. Ceramic armoring according to claim 28, wherein neighboring segments are joined together in one-piece manner on the at least one ceramic plate.

30. Ceramic armoring according to claim 28, wherein the at least one ceramic plate has a length and a width of at least 150 mm.

31. Ceramic armoring according to claim 30, wherein the at least one ceramic plate has a length and a width of at least 800 mm.

32. Ceramic armoring according to claim 1, wherein the spacing between crack stoppers is between 5 mm and 100 mm.

33. Ceramic armoring according to claim 1, wherein the ceramic material of the first ceramic layer and the second ceramic layer is an oxidic material or a non-oxidic material.

34. Ceramic armoring according to claim 1, wherein the ceramic material of the first ceramic layer and the second ceramic layer is a carbide ceramic material.

35. Ceramic armoring according to claim 1, wherein the first ceramic layer and the second ceramic layer is made of a monolithic ceramic material.

36. Ceramic armoring according to claim 1, wherein the first ceramic layer and the second ceramic layer is made of a fiber-reinforced ceramic material.

37. Method for the production of ceramic armoring, comprising:

producing a first ceramic layer incorporating crack stoppers and a second ceramic layer incorporating crack stoppers; and adhering the first ceramic layer to the second ceramic layer by a bonding layer in such a manner that the crack stoppers of the first ceramic layer and the crack stoppers of the second ceramic layer are offset with respect to each other in at least one transverse direction relative to a direction in which the first ceramic layer and the second ceramic layer succeed one another;

wherein the segments of different ceramic layers are produced with differing dimensions, the segments of a more outwardly located ceramic layer having smaller dimensions than the segments of a more inwardly located ceramic layer.

38. Method according to claim 37, wherein the first ceramic layer and the second ceramic layer is produced by means of at least one one-piece ceramic plate.

39. Method according to claim 37, wherein crack stoppers are produced in one or more preforms for the first ceramic layer and the second ceramic layer before the ceramizing process.

40. Method according to claim 39, wherein crack stoppers are produced in the form of recesses and cracks in a carbon-containing preform.

41. Method according to claim 37, wherein a foil is positioned on the outer ceramic layer.

* * * * *